US007087125B2

(12) United States Patent
Lin et al.

(10) Patent No.: US 7,087,125 B2
(45) Date of Patent: Aug. 8, 2006

(54) ALUMINUM ALLOY FOR PRODUCING HIGH PERFORMANCE SHAPED CASTINGS

(75) Inventors: Jen C. Lin, Export, PA (US); Cagatay Yanar, Pittsburgh, PA (US); Wenping Zhang, Murrysville, PA (US); Pål S. Jacobsen, Farsund (NO); Geir Grasmo, Mandal (NO); Michael K. Brandt, Murrysville, PA (US); Moustapha Mbaye, Ada, MI (US); Martijn Vos, Böblingen (DE); Michael V. Glazoff, Murrysville, PA (US); Knut Pettesen, Farsund (NO); Svein Jorgensen, Kristiansand (NO); Terje Johnsen, Vanse (NO)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 11/045,845

(22) Filed: Jan. 28, 2005

(65) Prior Publication Data

US 2005/0191204 A1 Sep. 1, 2005

Related U.S. Application Data

(60) Provisional application No. 60/540,802, filed on Jan. 30, 2004.

(51) Int. Cl.
*C22C 21/02* (2006.01)

(52) U.S. Cl. ..... 148/417; 420/532

(58) Field of Classification Search ..... 148/417; 420/532, 531, 548, 549
See application file for complete search history.

(56) References Cited

U.S. PATENT DOCUMENTS

| | | | | |
|---|---|---|---|---|
| 6,267,829 | B1 * | 7/2001 | Backerud et al. | 148/415 |
| 6,511,555 | B1 * | 1/2003 | Feikus et al. | 148/417 |
| 6,783,869 | B1 * | 8/2004 | Humer et al. | 428/650 |
| 2002/0155023 | A1 * | 10/2002 | Barresi et al. | 420/546 |
| 2003/0178106 | A1 * | 9/2003 | DasGupta | 148/439 |

FOREIGN PATENT DOCUMENTS

| | | | |
|---|---|---|---|
| JP | 56163234 | A * | 12/1981 |
| JP | 61139635 | A * | 6/1986 |

OTHER PUBLICATIONS

"Aluminum and Aluminum Alloys", ASM International, 1993, pp. 26, 41, 91-93, 104, 718-721.*

* cited by examiner

*Primary Examiner*—George Wyszomierski
*Assistant Examiner*—Janelle Morillo
(74) *Attorney, Agent, or Firm*—Greenberg Traurig LLP; Harry A. Hild, Jr.

(57) ABSTRACT

An aluminum alloy for shaped castings, the alloy having the following composition ranges in weight percent: about 6.0–8.5% silicon, less than 0.4% magnesium, less than 0.1% cerium, less than 0.2% iron, copper in a range from about 0.1% to about 0.5% and/or zinc in a range from about 1% to about 4%, the alloy being particularly suited for T5 heat treatment.

23 Claims, 5 Drawing Sheets

ALUMINUM ALLOY FOR PRODUCING HIGH PERFORMANCE SHAPED CASTINGS

CROSS REFERENCE TO RELATED APPLICATION

The present invention is based on the provisional patent application entitled An Aluminum Alloy for Producing High Performance Permanent and Semi-Permanent Mold Castings, Application No. 60/540,802 Filed on Jan. 30, 2004.

FIELD OF THE INVENTION

This invention relates to aluminum alloys and, more specifically, it relates to aluminum casting alloys and heat treatment therefore.

BACKGROUND OF THE INVENTION

Concerns for the environment and for energy supplies have resulted in a demand for lighter motor vehicles. It is desirable, therefore, to provide motor vehicle chassis and suspension system components of high strength aluminum alloys. Currently, most automotive chassis and suspension system components are made by assembly of multiples of small parts made by extrusion, hydroforming, welding, etc. The most common materials are cast iron, austenitic ductile iron, or aluminum alloys. The typical minimum yield strength is in the range from 150–190 MPa with a 5 to 10% elongation.

Aluminum casting alloys presently in use contain silicon to improve castability and magnesium to improve the mechanical properties. The presence of magnesium causes the formation of large intermetallic particles which cause reduced toughness. A typical aluminum casting alloy currently in use is A356 with a T6 temper. T6 heat treatment, which has the detrimental effect of causing dimensional changes, is required for such alloys.

The cost of such components is very high due to the many operations involved in their manufacture. These include casting, heat treatment, quench and straightening. To reduce that cost and simultaneously improve product performance, the challenge is to make one piece castings at lower cost that outperform the fabricated products. However, casting processes naturally present problems related to their limitations, which include minimum wall thickness, part distortion from mold ejection, solution heat treatment, and quench. The minimum wall thickness for vehicle component castings is typically 2.5 mm.

Solution heat treatment and quenching are commonly used for castings to achieve adequate mechanical properties. The heat treatment referred to as T6 employs temperatures sufficiently high that brittle eutectic structures are eliminated by solid-state diffusion. Such solution heat treatment introduces distortions due to creep at the high temperatures employed. Quenching introduces distortions due to the residual stresses introduced during the quench. These distortions require correction by machining or by plastic deformation processes. Solution heat treatment and quenching are both expensive. Correction of distortion is also expensive, or may, in large components, be impossible.

The elimination of solution heat treatment and quenching is, therefore, very desirable for vehicle cast products, particularly for large and complex structural components such as subframe, engine cradle, etc. It is, therefore, desirable to provide an alloy which can achieve the required mechanical properties with only a T5 temper, which is a low temperature artificial ageing process. The temperatures used for T5 temper are generally below 200° C. At the low temperatures employed for T5 temper, creep does not cause significant distortion.

It has been found that the need for solution heat treatment is eliminated if constituents which cause large particles are reduced or eliminated from the melt, and elements are added which, during T5 temper, cause fine grain precipitates. The elimination of large particles improves fracture toughness and ductility. The presence of fine grain precipitates provides increased strength.

INTRODUCTION TO THE INVENTION

The invention is an aluminum casting alloy having the following composition range. The concentrations of the alloying ingredients are expressed in weight percent.

about 6%–8.5% silicon,
less than about 0.4% magnesium,
less than about 0.2% iron;
copper in a range from about 0.1% to about 0.5%, and/or
zinc in a range from about 1% to about 4%;
plus silicon modifiers such as strontium, sodium, etc and grain refiners.

Commercial grain refiners for aluminum include rods of aluminum master alloy containing micron sized titanium diboride particles.

The preferred composition ranges for alloys of the present invention are as follows:

6.5%–7.5% silicon,
0. 15%–0.3% magnesium,
less than 0.15% iron;
less than 0.04% cerium;
copper in a range from about 0.3% to 0.4% and/or
zinc in a range from about 1% to 3%;
plus silicon modifiers such as strontium, sodium, etc and grain refiners.

By reducing the amount of magnesium, the requirement for T6 heat treatment is eliminated. Mechanical properties are improved by increasing the copper content and/or the zinc content. Alloys of the present invention are intended for use in F-temper (as cast) and in T5 temper.

SUMMARY OF THE INVENTION

In one aspect, the present invention is an aluminum alloy substantially comprising the following:

about 6%–8.5% silicon,
less than about 0.4% magnesium,
less than about 0.2% iron,
copper in a range from about 0.1% to about 0.5%, and/or
zinc in a range from about 1% to about 4%.

In another aspect, the present invention is a shaped aluminum alloy casting, a composition of the aluminum alloy casting substantially comprising the following:

about 6%–8.5% silicon,
less than about 0.4% magnesium,
less than about 0.2% iron,
copper in a range from about 0.1% to about 0.5%, and/or
zinc in a range from about 1% to about 4%.

In an additional aspect, the present invention is a method of producing an aluminum alloy shaped casting, the method comprising:

preparing an aluminum alloy melt, the aluminum alloy melt substantially comprising:
about 6%–8.5% silicon,
less than about 0.4% magnesium,
less than about 0.2% iron,
copper in a range from about 0.1% to about 0.5%, and/or zinc in a range from about 1% to about 4%.

casting the aluminum alloy melt in a mold to form the shaped casting; and removing the shaped casting from the mold.

DETAILED DESCRIPTION OF PREFERRED EMBODIMENTS

Figure 1:
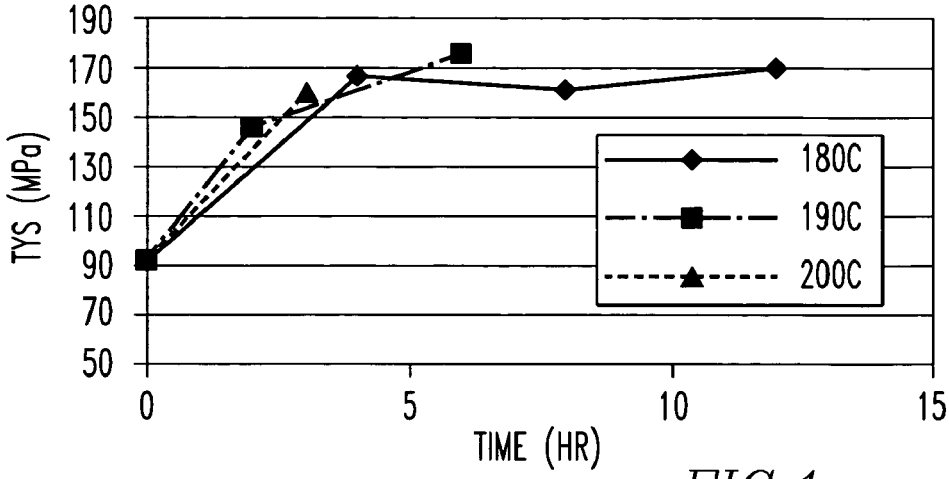
FIG. 1 is an ageing curve for tensile yield stress of an aluminum alloy having 7% silicon, 0.16% magnesium, and 0.35% copper.

The following tables, 1–2 and 4–15, present experimental data for a number of different compositions which are examples of the present invention. The alloy shown in Table 3 is not in accordance with the present invention, and is provided for comparison.

For each experiment, the composition is given in the first two lines of the table. The alloying elements presented are silicon, magnesium, copper, zinc, iron, titanium, boron and strontium. The balance, of course, is substantially aluminum. The molten alloy was poured into a directional solidification mold, which is a vertical, insulated mold resting on a chilled plate. A rapid solidification rate was obtained at the lower end of the resulting directionally solidified ingot, and lower solidification rates were obtained at higher elevations. A calibration of solidification rate versus elevation in the ingot was obtained by means of immersed thermocouples.

In the first column of these tables, the solidification rate is presented. The dimension in parentheses is the height of the point in the ingot where the solidification rate is obtained. The next column indicates the temper which was employed. As known in the art, T5 refers to a low temperature artificial ageing such as 180° C. for 8 hours. F refers to the as-cast sample. T6 refers to a high temperature solution heat treatment.

TYS refers to the tensile yield stress in MPa. UTS is the ultimate tensile stress in MPa, and E is the percentage elongation. For some of the samples, the dendrite arm spacing, DAS, is presented. The dendrite arm spacing is indicative of cooling rate.

TABLE 1

| Composition | Si | Mg | Cu | Zn | Fe | Ti | B | Sr |
|---|---|---|---|---|---|---|---|---|
| | 7.03 | 0.16 | 0.35 | 0.00 | 0.06 | 0.127 | 0.0005 | 0.015 |
| Solidification Rate | Temper | | TYS (MPa) | UTS (MPa) | E (%) | | | DAS (um) |
| 7 C./sec (1") | T5 | | 160.4 | 256.7 | 14 | T5 - 180° C. for 8 hrs | | 21.8 |
| 7 C./sec (1") | T5 | | 159.6 | 255.7 | 15 | | | |
| 4 C./sec (2") | T5 | | 162.3 | 251.9 | 11 | | | 24.4 |
| 4 C./sec (2") | T5 | | 163.5 | 252.7 | 12 | | | |
| 1 C./sec (4") | T5 | | 150.5 | 231.8 | 10 | | | 34.6 |
| 1 C./sec (4") | T5 | | 149.2 | 232.9 | 10 | | | |

Table 1 presents results of an experiment performed at the Alcoa Technical Center. An aluminum alloy melt was prepared having 7.03% silicon, a low magnesium level, and having 0.35% copper. Six samples were cut from the ingot, at three different elevations and these were subjected to tensile testing. Tensile yield stresses ranging from 149.2 to 163.5 were obtained. Ultimate tensile strengths ranging from 231.8 to 256.7 were also obtained. The lower values for each of these properties were obtained at the top of the ingot where the cooling rate was about 1 C/sec. The higher values were obtained at lower levels in the ingot where the cooling rate was higher. Elongations ranged from 10% to 15%. All of the samples shown were subjected to a T5 heat treatment to improve the mechanical properties. The T5 heat treatment consisted of heating the samples to 180° C. and holding them at that temperature for eight hours.

TABLE 2

| Composition | Si | Mg | Cu | Zn | Fe | Ti | B | Sr |
|---|---|---|---|---|---|---|---|---|
| | 7.04 | 0.17 | 0.35 | 0.73 | 0.05 | 0.129 | 0.0003 | 0.014 |
| Solidification Rate | Temper | | TYS (MPa) | UTS (MPa) | E (%) | | | DAS (um) |
| 7 C./sec (1") | T5 | | 158.4 | 252.1 | 10 | T5- 180° C. for 8 hrs | | |
| 7 C./sec (1") | T5 | | 159.9 | 256.3 | 14 | | | |
| 4 C./sec (2") | T5 | | 163.9 | 254.1 | 15 | | | 25.2 |
| 4 C./sec (2") | T5 | | 163.7 | 253.7 | 15 | | | |
| 1 C./sec (4") | T5 | | 155.5 | 240.6 | 11 | | | |
| 1 C./sec (4") | T5 | | 154.7 | 240.7 | 12 | | | |

Table 2 illustrates the effect of adding 0.73% zinc to the alloy of Table 1. Tensile yield stresses ranging from 154.7 MPa to 163.9 MPa were obtained. Ultimate tensile strengths ranged from 240.6 MPa to 256.3 MPa. It is seen that the mechanical properties of the samples in Table 2 varied much less than the mechanical properties of the samples in Table 1.

TABLE 3

| Composition | Si | Mg | Cu | Zn | Fe | Ti | B | Sr |
|---|---|---|---|---|---|---|---|---|
| | 7.01 | 0.177 | 0.00 | 0.0025 | 0.0867 | 0.1092 | 0.0009 | 0.0072 |
| Solidification Rate | Temper | | TYS (MPa) | UTS (MPa) | E (%) | | | DAS (um) |
| | F | | 89.5 | 199.7 | 14.2 | | | 23 |
| | T5 | | 143.5 | 218 | 10.2 | T5- 180° C. for 8 hrs | | |
| | T6 | | 165.7 | 255.8 | 13.8 | | | |

Table 3 presents results for a shaped casting made from an alloy having a composition similar to that presented in Table 2, except that copper was not included in the melt. The solidification rate is inferred from the dendrite arm spacing, which was 23 microns. The solidification rate is inferred to be about 7 C/sec.

One sample was tested as-cast (F-temper). One was a T5 temper and one was a T6 temper. The tensile yield strength and ultimate tensile strength for these samples in T5 temper was inferior to the values for these quantities shown in Tables 1 and 2. The values for T6 are quire good, but for the present invention, where T6 tempering is to be avoided, the T6 values are not relevant. The alloy illustrated in Table 3 is not within the scope of the present invention. It is included to show the beneficial results of copper or zinc additions.

TABLE 4

| Composition | Si | Mg | Cu | Zn | Fe | Ti | B | Sr |
|---|---|---|---|---|---|---|---|---|
| | 6.95 | 0.23 | 0.36 | 0.00 | 0.07 | 0.126 | 0.0006 | 0.005 |
| Solidification Rate | Temper | | TYS (MPa) | UTS (MPa) | E (%) | | | DAS (um) |
| 4 C./sec (2") | T5 | | 167 | 251.5 | 12 | T5 - 180° C. for 8 hrs | | 26.1 |
| 4 C./sec (2") | T5 | | 167.5 | 251.5 | 12 | | | |

TABLE 5

| Composition | Si | Mg | Cu | Zn | Fe | Ti | B | Sr |
|---|---|---|---|---|---|---|---|---|
| | 7.01 | 0.28 | 0.36 | 0.00 | 0.07 | 0.125 | 0.0015 | 0.016 |
| Solidification Rate | Temper | | TYS (MPa) | UTS (MPa) | E (%) | | | DAS (um) |
| 4 C./sec (2") | T5 | | 197 | 277 | 11 | T5 - 180° C. for 8 hrs | | 26.4 |
| 4 C./sec (2") | T5 | | 193 | 277 | 10 | | | |

TABLE 6

| Composition | Si | Mg | Cu | Zn | Fe | Ti | B | Sr |
|---|---|---|---|---|---|---|---|---|
| | 6.98 | 0.34 | 0.36 | 0.00 | 0.07 | 0.123 | 0.0000 | 0.008 |
| Solidification Rate | Temper | | TYS (MPa) | UTS (MPa) | E (%) | | | DAS (um) |
| 4 C./sec (2") | T5 | | 204 | 281.5 | 7 | T5 - 180° C. for 8 hrs | | 27.2 |
| 4 C./sec (2") | T5 | | 202 | 284 | 10 | | | |

Tables 4, 5 and 6 present results of directional solidification of molten aluminum alloys having approximately 7% silicon, 0.36% copper and no zinc, with increasing amounts of magnesium. It is seen that increasing magnesium, generally, increases the yield and ultimate tensile stresses, but tends to decrease the elongation.

TABLE 7

| Composition | Si | Mg | Cu | Zn | Fe | Ti | B | Sr |
|---|---|---|---|---|---|---|---|---|
| | 7.33 | 0.24 | 0.32 | 0.00 | 0.09 | 0.12 | 0.0049 | 0.013 |
| Solidification Rate | Temper | | TYS (MPa) | UTS (MPa) | E (%) | | | DAS (um) |
| 805957-1 (Pos. 3) | F | | 104 | 203 | 10 | | | 34 |
| 805957-2 (Pos. 3) | F | | 96 | 197 | 9 | | | |
| 805957-3 (Pos. 3) | T5 | | 177 | 245 | 4 | T5 - 180° C. for 8 hrs | | |
| 805957-4 (Pos. 3) | T5 | | 174 | 242 | 4 | | | |
| 805957-5 (Pos. 5) | T5 | | 177 | 228 | 3 | | | |
| 805957-6 (Pos. 5) | T5 | | 173 | 237 | 4 | | | |

Table 7 presents results for a shaped casting of an aluminum alloy having about 7.33% silicon, 0.24% Magnesium and 0.32% copper and no zinc. The information under "Solidification Rate" actually identifies samples. Six samples were cut from positions labeled 3 and 5. Two were tested in F temper, and four were tested in T5 temper. In lieu of direct solidification rate information, the dendrite arm spacing, 34 microns, is presented.

TABLE 8

| Composition | Si | Mg | Cu | Zn | Fe | Ti | B | Sr |
|---|---|---|---|---|---|---|---|---|
| | 7.25 | 0.26 | 0.3 | 0.00 | 0.09 | 0.13 | 0.0056 | 0.012 |
| Solidification Rate | Temper | | TYS (MPa) | UTS (MPa) | E (%) | | | DAS (um) |
| 805958-1 (Pos. 3) | F | | 102 | 196 | 8 | | | 29.5 |
| 805958-2 (Pos. 3) | F | | 100 | 200 | 8 | | | |
| 805958-3 (Pos. 3) | T5 | | 178 | 239 | 4 | T5 - 180° C. for 8 hrs | | |
| 805958-4 (Pos. 3) | T5 | | 175 | 241 | 4 | | | |
| 805958-5 (Pos. 5) | T5 | | 177 | 238 | 4 | | | |
| 805958-6 (Pos. 5) | T5 | | 175 | 230 | 3 | | | |

Table 8, like Table 7, presents results for a shaped casting of an aluminum alloy. The alloy for the data in Table 8 has about 7.25% silicon, 0.26% magnesium, 0.3% copper, and no zinc. The information under "Solidification Rate" actually identifies samples. Six samples were cut from positions labeled 3 and 5. Two were tested in F temper, and four were tested in T5 temper. In lieu of direct solidification rate information, the dendrite arm spacing, 29.5 microns, is presented.

TABLE 9

| Composition | Si | Mg | Cu | Zn | Fe | Ti | B | Sr |
|---|---|---|---|---|---|---|---|---|
| | 7.05 | 0.24 | 0.28 | 1.80 | 0.02 | 0.125 | 0.0017 | 0.02 |
| Solidification Rate | Temper | | TYS (MPa) | UTS (MPa) | E (%) | | | DAS (um) |
| 7 C./sec (1") | T5 | | 178.8 | 269.7 | 11 | T5 - 180° C. for 8 hrs | | |
| 7 C./sec (1") | T5 | | 177.5 | 269.3 | 12 | | | |
| 4 C./sec (2") | F | | 107.3 | 221.6 | 14 | | | |
| 4 C./sec (2") | F | | 107.2 | 222.2 | 16 | | | |
| 1 C./sec (4") | T5 | | 164.3 | 237.3 | 5 | | | |
| 1 C./sec (4") | T5 | | 162.3 | 239.2 | 6 | | | |

Table 9 presents results of a directional solidification experiment for an aluminum alloy containing 7.05% silicon, 0.24% magnesium, 0.28% copper and 1.80% zinc. As was seen earlier in Table 2, the addition of zinc reduces the spread in values for tensile yield stress for different cooling rates, and also the spread in values for ultimate tensile stress for different cooling rates.

TABLE 10

| Composition | Si | Mg | Cu | Zn | Fe | Ti | B | Sr |
|---|---|---|---|---|---|---|---|---|
| | 7.08 | 0.3 | 0.29 | 1.80 | 0.02 | 0.12 | 0 | 0.011 |
| Solidification Rate | Temper | | TYS (MPa) | UTS (MPa) | E (%) | | | DAS (um) |
| 7 C./sec (1") | T5 | | 167.7 | 262.9 | 14 | T5 - 180° C. for 8 hrs | | |
| 7 C./sec (1") | T5 | | 168.6 | 262.2 | 13 | | | |
| 4 C./sec (2") | F | | 108.3 | 222 | 17 | | | |
| 4 C./sec (2") | F | | 107.7 | 221.9 | 19 | | | |
| 1 C./sec (4") | T5 | | 175.2 | 252.3 | 7 | | | |
| 1 C./sec (4") | T5 | | 174.5 | 252.1 | 7 | | | |

Table 10 presents results of a directional solidification experiment for an aluminum alloy containing 7.08% silicon, 0.3% magnesium, 0.29% copper and 1.80% zinc. The principal difference between Table 9 and Table 10 is the increased magnesium content of the composition in Table 10. Surprisingly, the yield strength shown for the slower cooling rate, 1 C/sec is greater than the yield strength shown for the faster cooling rate, 7 C/sec.

TABLE 11

| Composition | Si | Mg | Cu | Zn | Fe | Ti | B | Sr |
|---|---|---|---|---|---|---|---|---|
| | 7.08 | 0.3 | 0.29 | 1.80 | 0.02 | 0.12 | 0 | 0.011 |
| Cool inside the mold Solidification Rate | Temper | | TYS (MPa) | UTS (MPa) | E (%) | | | DAS (um) |
| 7 C./sec (1") | T5 | | 111.6 | 220.7 | 16 | T5 - 180° C. for 8 hrs | | |
| 7 C./sec (1") | T5 | | 112.3 | 221.3 | 16 | | | |
| 4 C./sec (2") | F | | 89.9 | 202.6 | 16 | | | |
| 4 C./sec (2") | F | | 91.5 | 202.3 | 16 | | | |

TABLE 11-continued

| | | | | |
|---|---|---|---|---|
| 1 C./sec (4") | T5 | 125.6 | 219.3 | 9 |
| 1 C./sec (4") | T5 | 125.1 | 220.4 | 9 |

Table 11 presents directional solidification data for the same alloy as the alloy of Table 10. However, the post-casting thermal history was different. The ingot was left in the mold to cool slowly from the solidification temperature down to room temperature. The tensile yield stresses shown in Table 11 are lower than those in Table 10, as are the ultimate tensile stress values. The values shown for elongation, however, are greater.

TABLE 12

| Composition | Si | Mg | Cu | Zn | Fe | Ti | B | Sr |
|---|---|---|---|---|---|---|---|---|
| | 7.08 | 0.3 | 0.29 | 1.80 | 0.02 | 0.12 | 0 | 0.011 |
| Water Cool After Casting | | | | | | | | |
| Solidification Rate | Temper | | TYS (MPa) | UTS (MPa) | E (%) | | | DAS (um) |
| 7 C./sec (1") | T5 | | 189.2 | 282.8 | 12 | T5 - 180° C. for 8 hrs | | |
| 7 C./sec (1") | T5 | | 188.2 | 283.2 | 12 | | | |
| 4 C./sec (2") | F | | 111.9 | 234.8 | 16 | | | |
| 4 C./sec (2") | F | | 112.6 | 235.4 | 16 | | | |
| 1 C./sec (4") | T5 | | 176.3 | 248 | 6 | | | |
| 1 C./sec (4") | T5 | | 178.7 | 250 | 6 | | | |

The data shown in Table 12 are for the same alloy that was shown in Tables 10 and 11. However, after solidification was complete, the ingot was removed from the mold and quenched in water. Higher values were obtained for tensile yield stress than were shown in Tables 10 and 11. Ultimate tensile stress values, also, were higher. Values for elongation, however, were lower.

TABLE 13

| Composition | Si | Mg | Cu | Zn | Fe | Ti | B | Sr |
|---|---|---|---|---|---|---|---|---|
| | 7.09 | 0.26 | 0.3 | 2.68 | 0.02 | 0.124 | 0 | 0.009 |
| Solidification Rate | Temper | | TYS (MPa) | UTS (MPa) | E (%) | | | DAS (um) |
| 7 C./sec (1") | T5 | | 177.2 | 269.6 | 12 | T5 - 180° C. for 8 hrs | | |
| 7 C./sec (1") | T5 | | 177.1 | 269.2 | 14 | | | |
| 4 C./sec (2") | F | | 111.8 | 231.9 | 19 | | | |
| 4 C./sec (2") | F | | 112.7 | 230.5 | 19 | | | |
| 1 C./sec (4") | T5 | | 179.4 | 261.8 | 10 | | | |
| 1 C./sec (4") | T5 | | 179.1 | 261.5 | 9 | | | |

Table 13 presents results of a directional solidification experiment for an aluminum alloy containing 7.09% silicon, 0.26 magnesium, 0.3% copper and 2.68% zinc. The alloy of Table 13 has much more zinc than the alloy of tables 10, 11 and 12. The tensile yield stress values shown in Table 13 show less sensitivity to cooling rate than the stress values shown in Tables 10, 11 and 12.

TABLE 14

| Composition | Si | Mg | Cu | Zn | Fe | Ti | B | Sr |
|---|---|---|---|---|---|---|---|---|
| | 7.05 | 0.1 | 0 | 2.57 | 0.02 | 0.129 | 0.0014 | 0.014 |
| Solidification Rate | Temper | | TYS (MPa) | UTS (MPa) | E (%) | | | DAS (um) |
| 7 C./sec (1") | T5 | | 120.5 | 211.4 | 19 | T5 - 180° C. for 8 hrs | | |
| 7 C./sec (1") | T5 | | 117.8 | 212.9 | 16 | | | |
| 4 C./sec (2") | F | | 85 | 194.7 | 25 | | | |
| 4 C./sec (2") | F | | 82.2 | 194.4 | 25 | | | |
| 1 C./sec (4") | T5 | | 121.2 | 204.1 | 18 | | | |
| 1 C./sec (4") | T5 | | 123.3 | 204.6 | 17 | | | |

Table 14 presents data for a directional solidification experiment of an aluminum alloy containing 7.05% silicon, 0.1% magnesium (lower than the preceding compositions), no copper and 2.57% zinc. Lowered tensile and yield properties are seen for this composition, but elongation is increased.

TABLE 15

| Composition | Si | Mg | Cu | Zn | Fe | Ti | B | Sr |
|---|---|---|---|---|---|---|---|---|
| | 8.2 | 0.26 | 0.29 | 2.72 | 0.02 | 0.129 | 0.0004 | 0.008 |
| Solidification Rate | Temper | | TYS (MPa) | UTS (MPa) | E (%) | | | DAS (um) |
| 7 C./sec (1") | T5 | | 120.5 | 235.4 | 15 | T5 - 180° C. for 8 hrs | | |
| 7 C./sec (1") | T5 | | 120.5 | 235.7 | 15 | | | |
| 4 C./sec (2") | F | | 97 | 217 | 16 | | | |
| 4 C./sec (2") | F | | 96.7 | 217.2 | 16 | | | |
| 1 C./sec (4") | T5 | | 141.5 | 239 | 11 | | | |
| 1 C./sec (4") | T5 | | 140.7 | 238.5 | 10 | | | |

The alloy shown in Table 15, having a high silicon level, has excellent castability. Because of the copper and zinc levels, it also has good values for TYS, UTS and elongation.

FIGS. 1–6 present ageing data for two of the compositions cited above. FIG. 1 presents tensile yield stress versus time for an aluminum alloy with 7% silicon, 0.16% magnesium, 0.35% copper, and no zinc. Data are presented for T5 heat treatment for three temperatures, 180° C., 190° C. and 200° C., and for various times. It can be seen that the maximum tensile yield stress is attained in a time of about 4–6 hours at these temperatures.

Figure 2:
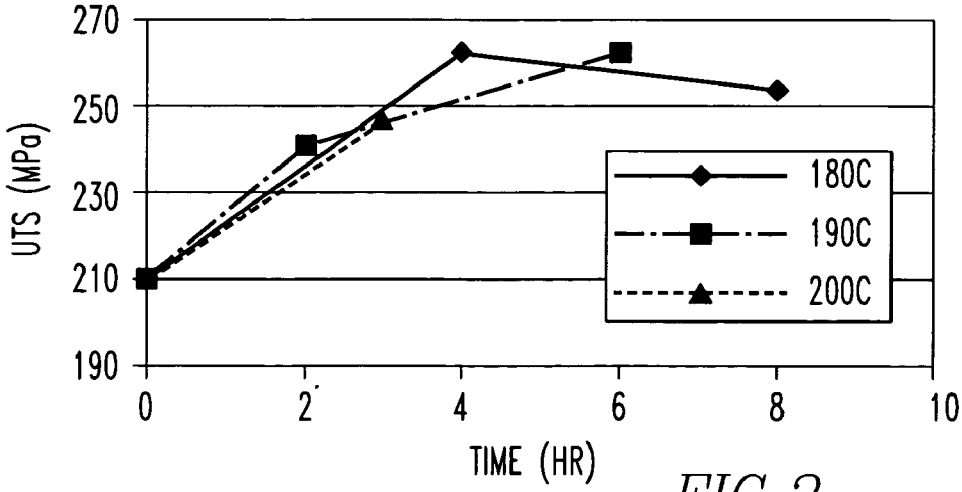
FIG. 2 is an ageing curve for ultimate tensile stress of the alloy of FIG. 1.

FIG. 2 presents ultimate tensile stress for the same alloy as the one shown in FIG. 1. Again, maximum properties were obtained in about 4–6 hours.

Figure 3:
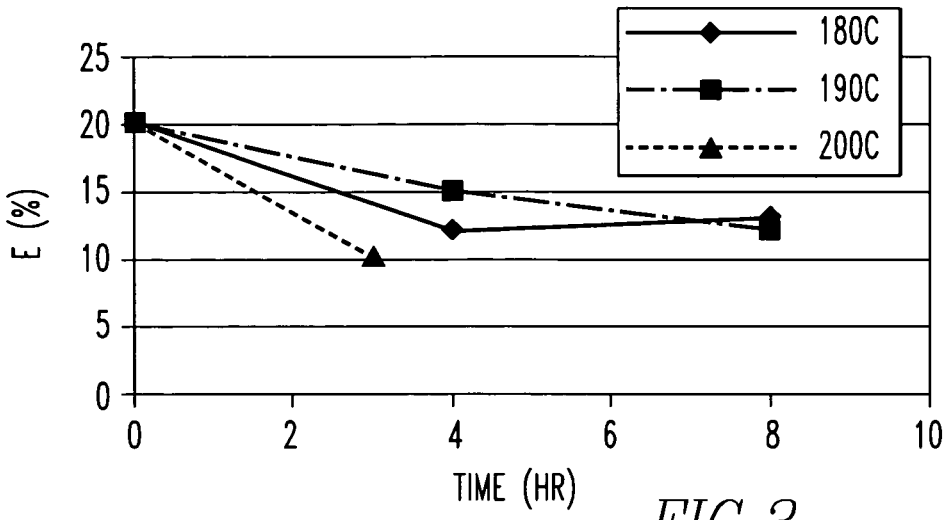
FIG. 3 is an ageing curve for elongation of the alloy of FIGS. 1 and 2.

FIG. 3 presents elongation versus heat treatment time for the same alloy. The reduction in elongation occurs in about 3–8 hours.

Figure 4:
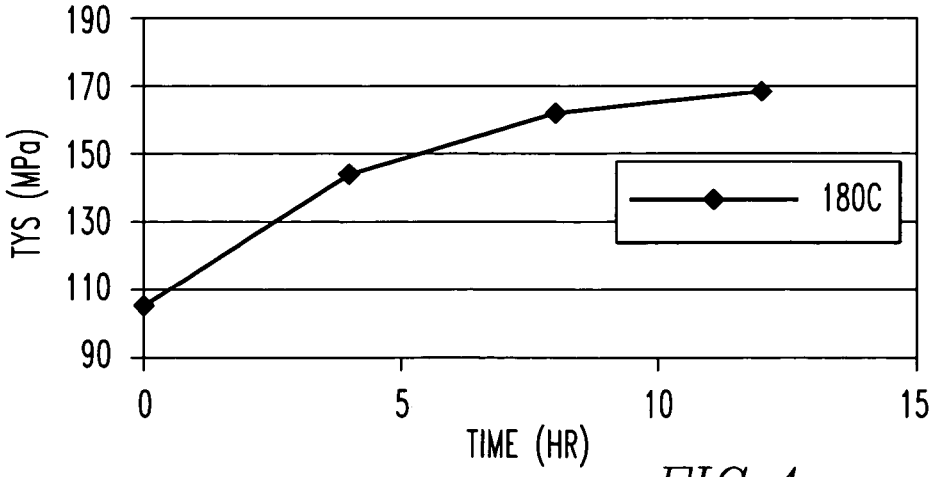
FIG. 4 is an ageing curve for tensile yield stress of an aluminum alloy having 7% silicon, 0.17% magnesium, 0.35% copper, and 0.73% zinc.
Figure 5:
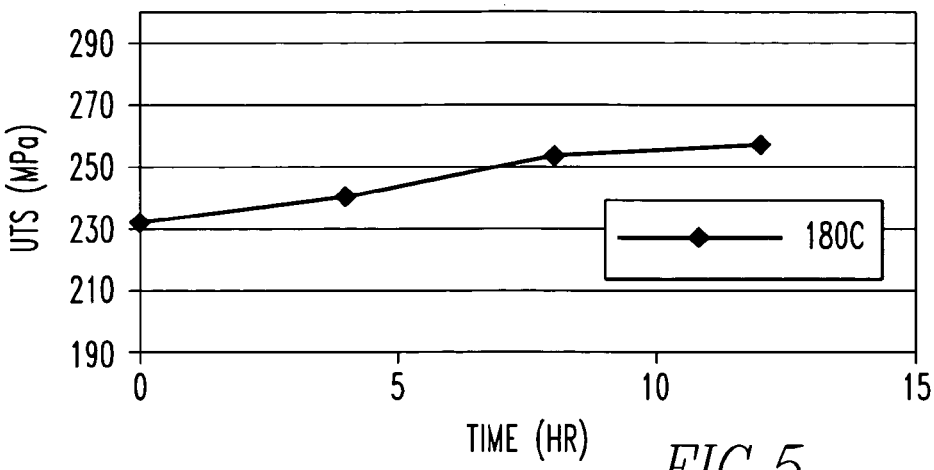
FIG. 5 is an ageing curve for ultimate tensile stress of the alloy of FIG. 4.
Figure 6:
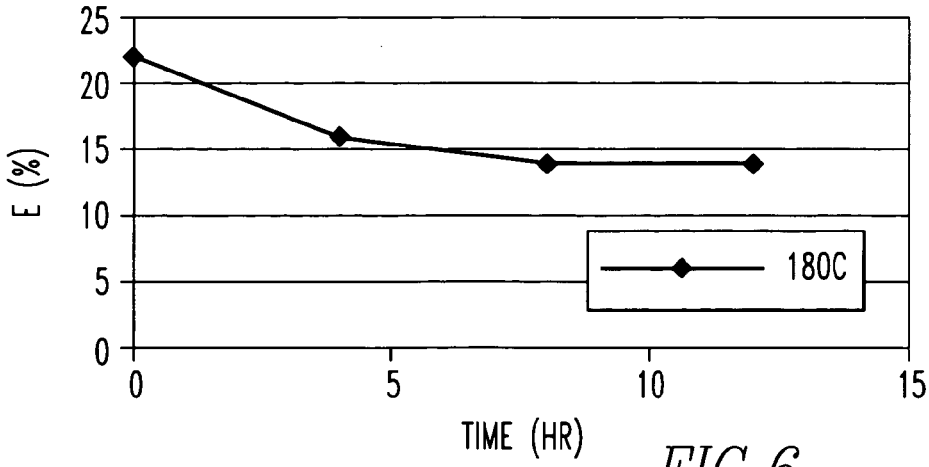
FIG. 6 is an ageing curve for elongation of the alloy of FIGS. 4 and 5.

FIGS. 4, 5 and 6 present data for an aluminum alloy with 7% silicon, 0.17% Mg, 0.35 Cu and 0.73 Zn. All of the ageing was done at 180° C. FIG. 4 shows that the maximum tensile yield stress was obtained in a time of about 12 hours. FIG. 5 shows increases of ultimate tensile stress for about the same time. FIG. 6 shows a drop in elongation in about 7 hours.

Figure 7:
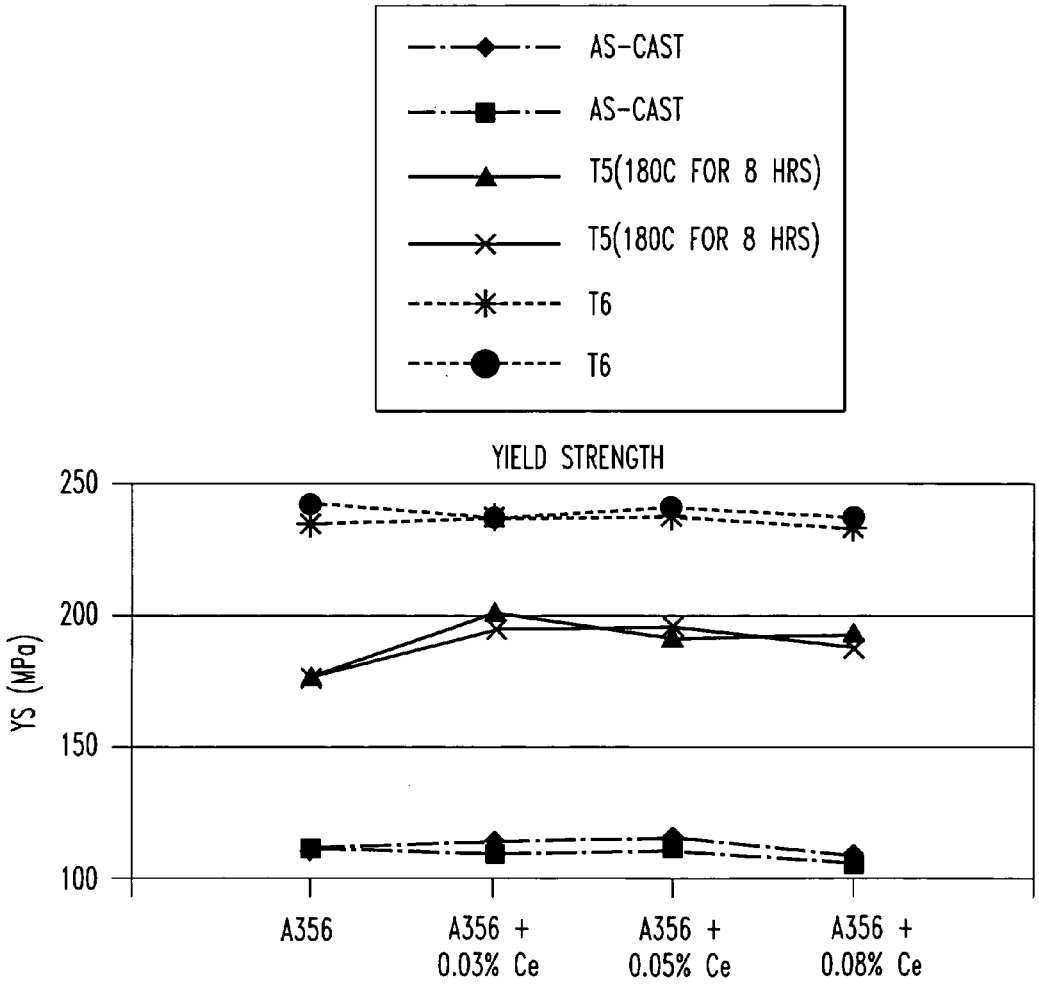
FIG. 7 is a plot presenting the effect of cerium on yield strength of the A356 aluminum alloy.

FIG. 7 shows the effect of cerium on yield stress and elongation of A 356 aluminum alloy having various cerium additions. These tests were to infer the effect of cerium on alloys of the present invention. Tests were performed for A 356 alloys with cerium additions of 0.03%, 0.05% and 0.08%. Cerium is employed as a substitute for beryllium for the purpose of reducing the oxidation of magnesium from the molten alloy prior to casting. Values are presented for the alloy in the as cast condition, after a T5 heat treatment and after a T6 solution heat treatment.

Figure 8:
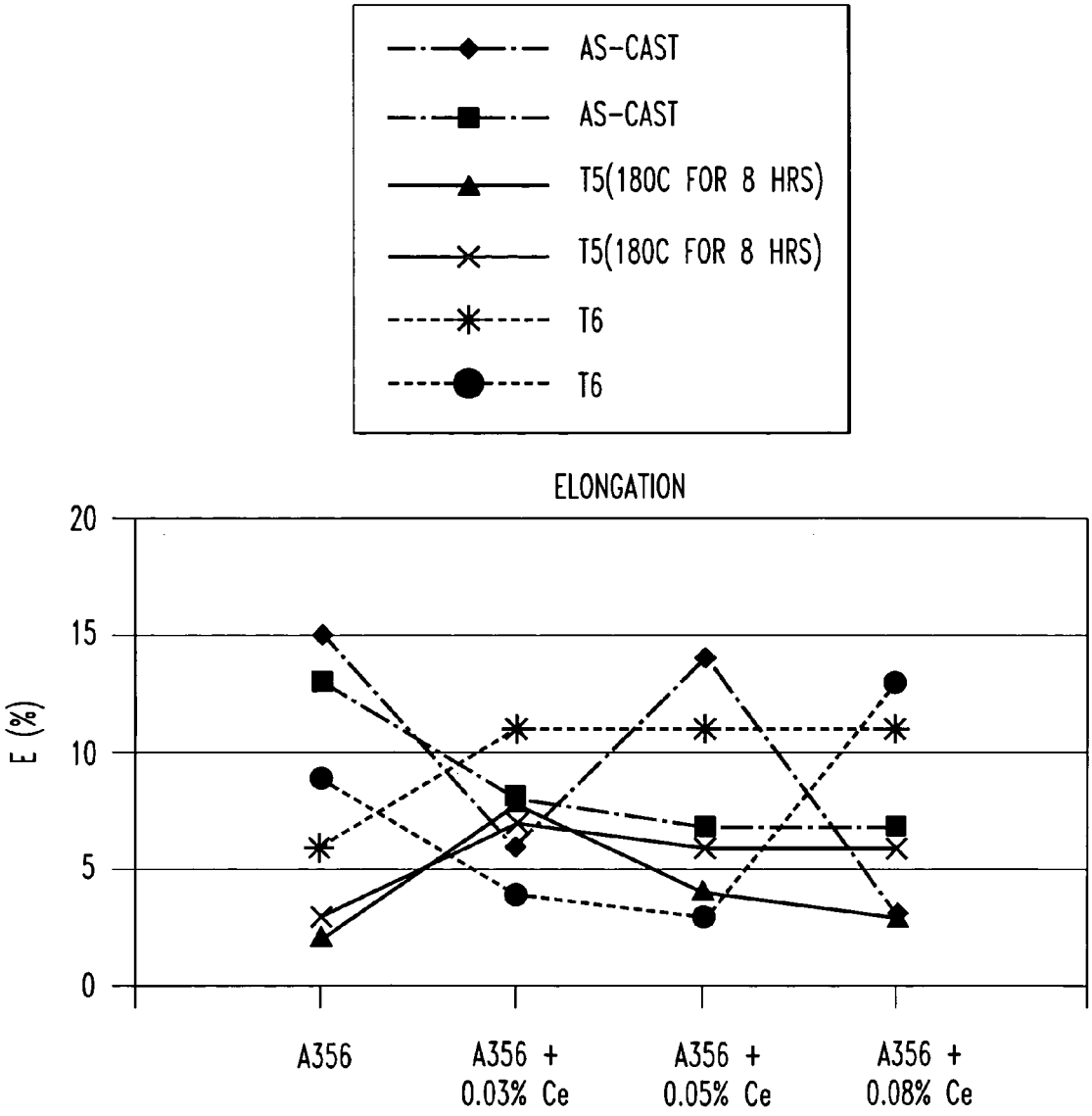
FIG. 8 is a plot presenting the effect of cerium on elongation of the A356 aluminum alloy.

FIG. 8 shows the effect of cerium additions on elongation of an A356 aluminum alloy. As before, tests were performed on samples with 0.03%, 0.05% and 0.08% cerium. Values are presented for the alloy in the as cast condition, after a T5 heat treatment and after a T6 solution heat treatment.

Although the preceding discussion has presented various presently preferred embodiments of the invention, it is to be understood that the invention may be otherwise embodied within the scope of the appended claims.

What is claimed is:

1. An aluminum alloy substantially comprising the following:

about 6%–8.5% silicon,
less than about 0.4% magnesium,
less than about 0.2% iron,
copper in a range from about 0.1% to about 0.5%, and
zinc in a range from about 1% to about 4%.

2. The aluminum alloy of claim 1 wherein said silicon is in a range from about 6%–8%.

3. The aluminum alloy of claim 1 further comprising silicon modifiers comprising strontium or sodium.

4. The aluminum alloy of claim 1 further comprising grain refiners.

5. The aluminum alloy of claim 1 wherein said silicon is in a range from about 6.5% to about 7.5%.

6. The aluminum alloy of claim 1 wherein said magnesium is in a range from about 0.15% to about 0.3%.

7. The aluminum alloy of claim 1 wherein said copper is in a range from about 0.30% to about 0.40%.

8. The aluminum alloy of claim 1 wherein said zinc is in a range from about 1% to about 3%.

9. The aluminum alloy of claim 1 wherein said zinc is in a range from about 2% to about 3%.

10. The aluminum alloy of claim 1 further comprising cerium in a range from about 0.03% to about 0.1%.

11. The aluminum alloy of claim 1 wherein said iron is limited to a range from about 0% to 0.15%.

12. A shaped aluminum alloy casting comprising:

an aluminum alloy composition comprising:

about 6%–8.5% silicon,
less than about 0.4% magnesium,
less than about 0.2% iron,
copper in a range from about 0.1% to about 0.5%, and
zinc in a range from about 1% to about 4%.

13. The shaped aluminum alloy casting of claim 12 wherein said silicon is in a range from about 6%–8%.

14. The shaped aluminum alloy casting of claim 12 wherein said silicon is in a range from about 6.5% to 7.5%.

15. The shaped aluminum alloy casting of claim 12 after T5 heat treatment.

16. The shaped aluminum alloy casting of claim 15 wherein said T5 heat treatment was done at a temperature below about 200 C.

17. The shaped aluminum alloy casting of claim 15 wherein said T5 heat treatment was done at a temperature of about 180 C.

18. The shaped aluminum alloy casting of claim 15 wherein said T5 heat treatment was done for a time of at least one hour.

19. The shaped aluminum alloy casting of claim 15 wherein said T5 beat treatment was done of a time of no more than 10 hours.

20. The shaped aluminum alloy casting of claim 12 in F temper.

21. The shaped aluminum alloy casting of claim 12 wherein said shaped aluminum alloy casting of said aluminum alloy when heat treated to T5 temper comprises substantially uniform tensile properties.

22. The shaped casting of claim 21 wherein said substantially uniform tensile properties comprises an increase in ultimate tensile strength of less than 3% from a first portion having a dendritic spacing of approximately 22 micrometers to a second portion having a dendritic spacing of approximately 35 micrometers.

23. The shaped casting of claim 21 wherein said substantially uniform tensile properties comprises an change in tensile yield strength of less than 1.5% from a first portion having a dendrite spacing of approximately 22 micrometers to a second portion having a dendritic spacing of approximately 35 micrometers.

* * * * *